United States Patent [19]

Timmerman et al.

[11] Patent Number: 4,694,785

[45] Date of Patent: Sep. 22, 1987

[54] PISTON APPARATUS

[76] Inventors: Tom Timmerman, 207-145 West 18th Street, North Vancouver, British Columbia, Canada, V7L 2V6; Norman V. Chapman, 20481-92A Avenue, Langley, Canada, V1M 1B7

[21] Appl. No.: 821,823

[22] Filed: Jan. 23, 1986

[51] Int. Cl.[4] ..... F02B 75/32

[52] U.S. Cl. ..... 123/52 A; 123/54 R; 123/197 AC

[58] Field of Search ..... 123/197 R, 197 AB, 197 AC, 123/52 A, 54, 192 B

[56] References Cited

U.S. PATENT DOCUMENTS

| | | | |
|---|---|---|---|
| 3,520,285 | 7/1970 | Klauder | 123/192 B |
| 4,543,919 | 10/1985 | Carson | 123/197 AC |

FOREIGN PATENT DOCUMENTS

| | | | |
|---|---|---|---|
| 52584 | 3/1912 | Austria | 123/54 R |
| 2303085 | 7/1974 | Fed. Rep. of Germany | 123/197 R |
| 149398 | 7/1981 | Fed. Rep. of Germany | 123/52 A |
| 1011422 | 6/1952 | France | 123/197 AC |

*Primary Examiner*—Craig R. Feinberg
*Attorney, Agent, or Firm*—Bull, Housser & Tupper

[57] ABSTRACT

A piston apparatus has a first pair of spaced-apart cylinders aligned along a cylinder axis. There is a pair of pistons, each piston being slidably received in one of the cylinders for reciprocation along the axis. A pair of spaced-apart crank members are on opposite sides of the cylinder axis. The crank members have parallel axes of rotation. Gears mechanically couple the crank members together for rotation at the same rotational speed and in the same direction. A crank connecting member has a longitudinal axis and opposite ends. Each end is connected to one of the crank members a distance from the axis of rotation thereof. A piston connecting member rigidly interconnects the pair of pistons and has a bearing for supporting the crank connecting member to permit relative movement between the piston connecting member and the crank connecting member along the longitudinal axis of the crank connecting member and for carrying the piston connecting member and the crank connecting member together in movement parallel to the cylinder axis.

6 Claims, 4 Drawing Figures

PISTON APPARATUS

BACKGROUND OF THE INVENTION

This invention relates to a piston apparatus, such as an engine, having opposing pistons rigidly connected together.

Apparatuses employing reciprocating pistons within cylinders connected to rotating shafts by cranks are typically employed as parts of internal combustion engines, external combustion engines and pumps. The commonest arrangement employs one or more pistons each slidably received within a cylinder. These apparatuses have rotating shafts provided with cranks. A piston rod is rotatably connected to the crank at one end and is hingedly connected to a piston at the other end.

Such apparatuses, while very common, have the disadvantage that the force transmitted between the piston and the crank along the piston rod is not along the longitudinal axis of the cylinder, but rather is applied at an angle according to the particular angular position of the piston rod. The force may thus be resolved into a component applied parallel to the direction of travel of the piston and a component perpendicular to the direction of travel. The perpendicular component tends to push the piston against the wall of the cylinder, increasing friction and wear of the internal cylinder surface. This results in the well-known fact that such cylinders tend to become oval-shaped over a period of time and eventually have to be rebored to restore the circular cross-section.

Attempts have been made to provide engines in which the force exerted by each piston rod is essentially along the longitudinal axis of the cylinder. These attempts have resulted in variations of a type of engine which may be referred to as the "Scotch yoke engine". By way of example only, such engines are disclosed in U.S. Pat. No. 4,013,048 to Ritz and U.S. Pat. No. 3,517,652 to Albertson. In these engines the cylinders are arranged in opposite pairs. The piston rods are supported by bearings which permit only movement along the longitudinal axis of the cylinders. The piston rods are both connected to a yoke housing which has a slot extending perpendicular to the cylinder axis. The crank is connected to a slider received within the slot. Consequently, there is no sideways force on the cylinders, this being rather absorbed by the bearings supporting the piston rods.

Scotch yoke type engines however offer disadvantages which have so far prevented widespread adoption to replace conventional piston engines. The yoke housing is supported by the piston rods and reciprocates therewith along the cylinder axis. In order to withstand the forces involved, this yoke housing must be relatively heavy and considerably increases the weight carried by the pistons and consequently the inertial forces upon the pistons. In practise it has not been easy to design a yoke which is sufficiently light and yet strong enough and compact enough for the purpose intended. It should also be noted that the type of engine still provides a sideways force which is transferred to the bearing supporting the piston rods. Thus wear of these bearings becomes a problem.

SUMMARY OF THE INVENTION

According to the invention, there is a piston apparatus having a first pair of spaced-apart cylinders aligned along a cylinder axis. There is a pair of pistons, each piston being slidably received in one of the cylinders for reciprocation along the axis. A pair of spaced-apart crank members are on opposite sides of the cylinder axis. The crank members have parallel axes of rotation. There is means for mechanically coupling the crank members together for rotation at the same rotational speed and in the same direction. A crank connecting member has a longitudinal axis, which is perpendicular to the cylinder axis, and opposite ends, each end being rotatably connected to one of the crank members a distance from the axis of rotation thereof. A piston connecting member interconnects the pair of pistons and has a bearing for supporting the crank connecting member to permit relative movement between the piston connecting member and the crank connecting member along the longitudinal axis of the crank connecting member and for carrying the piston connecting member and the crank connecting member together in movement parallel to the cylnder axis.

The bearing may include an aperture extending through the piston connecting member between the pairs of pistons in a direction perpendicular to the cylinder axis.

The means for mechanically coupling may be first and second gear wheels operatively connected to the crank members and a third gear wheel meshing with, and located between, the first and second gear wheels.

This type of piston apparatus provides distinct advantages over conventional piston apparatuses as well as the Scotch yoke type. Most of the force applied to the piston connecting member is co-axial with the longitudinal axis of the cylinders except for a small force attributable to friction between the crank connecting member and the bearing in the piston connecting member. Furthermore it should be noted that the weight carried by the pistons is not significantly increased when compared with a conventional engine. The piston connecting member can be comparatively light when compared with a Scotch Yoke housing. While the structure is unique, it is not unduly complicated and is relatively easy to machine, particularly since the cylinders are arranged in opposite pairs.

DESCRIPTION OF THE PREFERRED EMBODIMENTS

Figure 1:
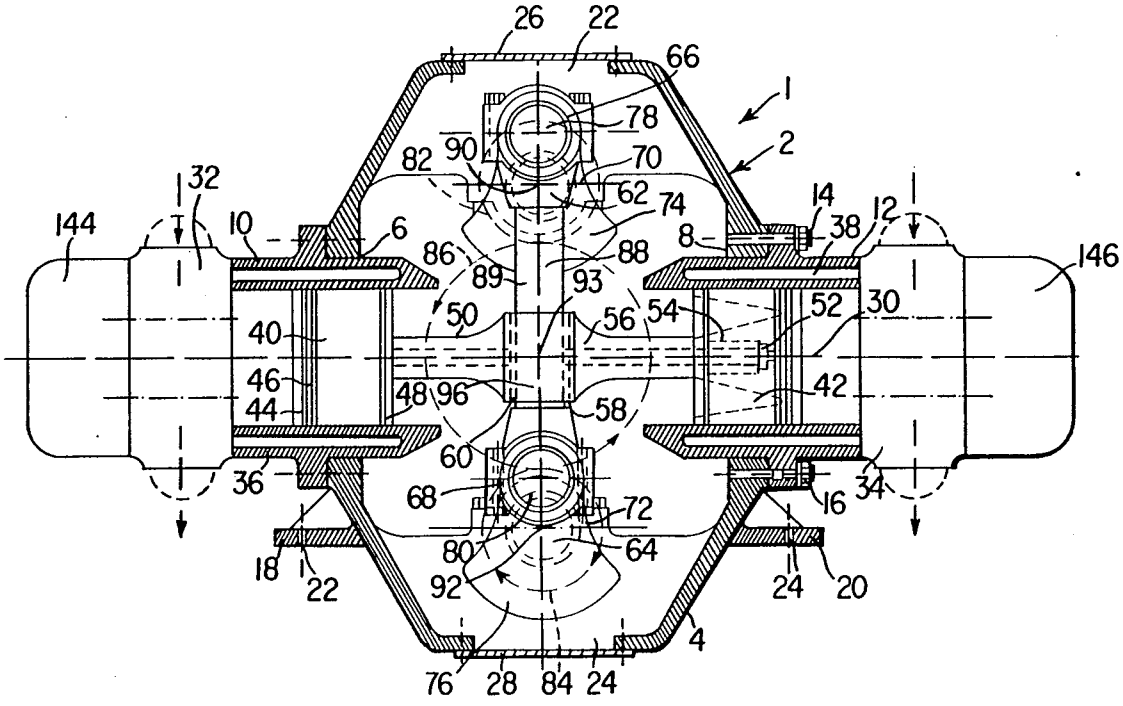
FIG. 1 is a vertical section of a piston apparatus according to the invention taken along the centre line of a pair of cylinders.
Figure 2:
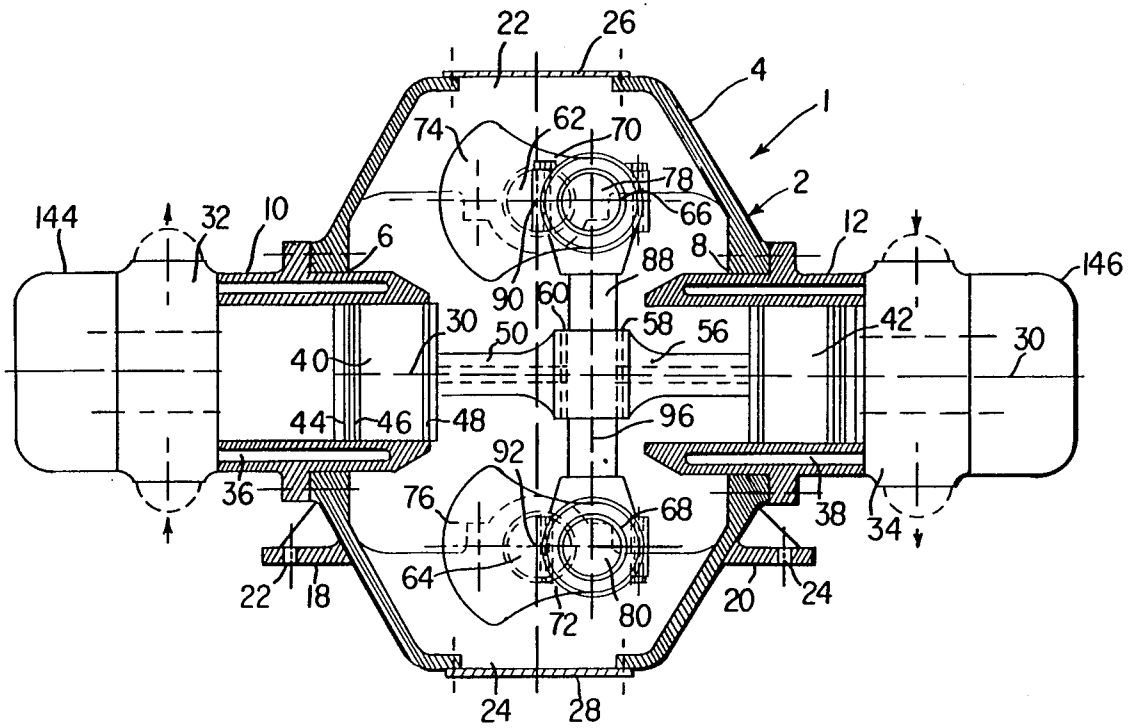
FIG. 2 is a sectional view similar to FIG. 1 showing the engine with the crank members rotated 90°.

Referring to the drawings, FIGS. 1 and 2 show a piston apparatus 1 according to an embodiment of the invention. The piston apparatus has a crankcase 2 which includes a hollow housing 4 having opposed apertures 6 and 8 which receive cylinders 10 and 12 respectively. The cylinders are bolted to the housing 4 by a plurality of bolts 14, 16, two of which only are illustrated for cylinder 12 in FIG. 1.

The crankcase is provided with motor mounts 18 and 20 having apertures 22 and 24 for bolting the apparatus to a support. The crankcase is also provided with a top opening 22 and a bottom opening 24 providing access to the interior of the apparatus for inspection or servicing. These are covered by top access plate 26 and bottom access plate 28 respectively held in position by suitable means such as bolts.

Piston apparatuses according to the invention have their cylinders arranged in opposite pairs. Apparatus 1 shown in FIGS. 1 and 2 has only the described pair of cylinders 10 and 12 which share a common longitudinal cylinder axis 30. The cylinders 10 and 12 have cylinder heads 32 and 34 on opposite sides of the apparatus. The cylinders 10 and 12 also have internal chambers 36 and 38 for receiving a cooling fluid.

A pair of pistons 40 and 42 are slidably received within the respective cylinders 10 and 12 and reciprocate along the cylinder axis 30. The pistons are conventional and are provided with piston rings, such as rings 44, 46 and 48 for piston 40.

The pistons 40 and 42 are interconnected, rigidly in this preferred case, by a piston connecting member 50. Each end of piston connecting member 50 is threaded and is received in a corresponding threaded aperture in one of the pistons. For example, threaded end 52 is received in a threaded aperture 54 of piston 42. The opposite end of piston connecting member 50 is similarly connected to piston 40. It should be noted that piston connecting member 50 is centred along cylinder axis 30. In this embodiment the piston connecting member is an elongated rod which is circular in section near its ends. There is an enlarged central portion 56 provided with an aperture 58 extending perpendicularly to cylinder axis 30. A friction reducing bushing 60 is tightly received in the aperture.

The piston apparatus 1 has a top crankshaft 62 and a bottom crankshaft 64. These are rotatably supported in bearings, similar to the bearings 138, 140 and 142 shown in the alternative embodiment of FIG. 3. Crank members 70 and 72 provided with counterweights 74 and 76 respectively are connected to the crankshafts. Crank members 70 and 72 are provided with crankpins 78 and 80 respectively.

Figure 4:
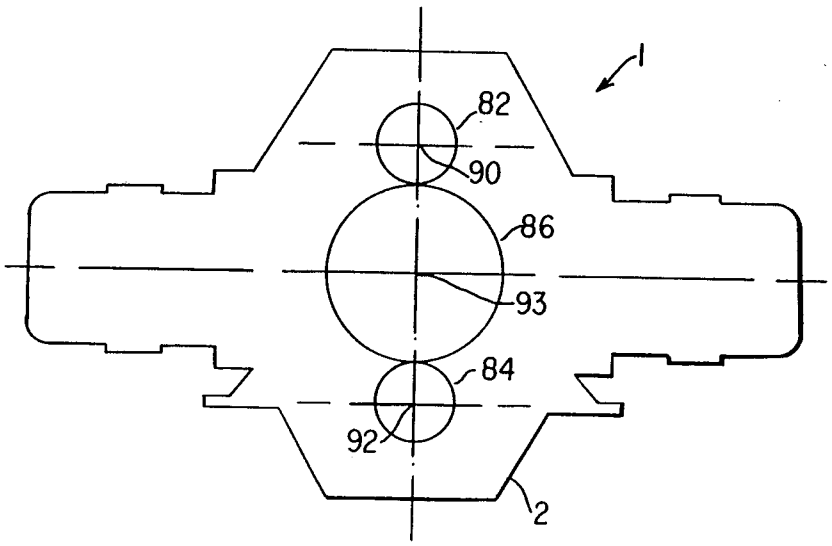
FIG. 4 is a diagrammatic elevation of the gears coupling the crank members together.

A gear wheel 82, illustrated in FIG. 1 and FIG. 4, is fixedly mounted on crankshaft 62 for rotation therewith. Similarly a gear wheel 84 of the same size is mounted on crankshaft 64. A third gear wheel 86 is rotatably mounted on crankcase 2 and is located between and meshes with both gear wheel 82 and gear wheel 84. The three gear wheels together with crankshafts 62 and 64 provide means for mechanically coupling the crank members together for rotation at the same rotational speed and in the same direction. In this embodiment it should be noted that the axes of rotation 90 and 92 of the gear wheels 82 and 84, which are also the axes of rotation of the crank members, are equidistant from cylinder axis 30. Similarly, each of the crankpins 78 and 80 are connected the same distance from the axis of rotation of its respective crank member. Gearwheel 86 has an axis of rotation 93 which is midway between axes 90 and 92 and is parallel to both.

Crank members 70 and 72 are connected together by a crank connecting member 88 having a bearing 66 at its top end which rotatably receives crankpin 78. At the bottom end is a bearing 68 which rotatably receives crankpin 80. The crank connecting member extends through aperture 58 and bushing 60 in piston connecting member 50. The aperture and bushing are shaped and sized to slidably receive the crank connecting member. In the particular case of the preferred embodiment as illustrated the crank connecting member and the aperture as well as the bushing are circular when viewed in section. The crank connecting member has a longitudinal axis 96 which is perpendicular to cylinder axis 30.

The operation of piston apparatus 1 is as follows. The pistons reciprocate back and forth in their respective cylinders simultaneously. FIG. 1 shows the pistons in the midway positions. FIG. 2 shows piston 42 at its end position for maximum compression, while piston 40 is at the opposite position where cylinder 10 has its maximum volume. Obviously the situation is reversed at the other end of the stroke of both pistons. As the pistons move back and forth together with the piston connecting member 50, crank members 70 and 72 rotate about crankshafts 62 and 64 respectively. As mentioned above, the crank members rotate at the same speed and in the same direction due to the meshing of gear wheels 82, 84 and 86. As the crank members simultaneously rotate, crankpins 78 and 80 rotate about the crankshafts.

Crank connecting member 88 moves together with crankpins 78 and 80 in a motion which has a component parallel to cylinder axis 30 and a component perpendicular to it. This may be observed by comparing FIGS. 1 and 2. In FIG. 1 cylinder connecting member 88 is at its uppermost position with both crankpins in their top position above their respective crankshafts. In FIG. 2 the crank members have rotated 90°, clockwise from the position of FIG. 1 and the crank connecting member has moved downwardly with respect to axis 30 to its midway position in its direction of motion perpendicular to axis 30. Clearly when the crank members have rotated another 90°, member 88 is at its lowest position with both crankpins vertically below the crankshafts. The component of motion parallel to axis 30 is also illustrated by comparing the figures. In FIG. 1 the crankpins are vertically aligned with the crankshafts and the crank connecting member is at its mid position with respect to motion parallel to axis 30. From the point of view of FIG. 2 the crankpins are immediately to the right of their respective crankshafts and member 88 is at its position furthest to the right in motion along axis 30. When the crank members have rotated 180° from the position of FIG. 2, member 88 is at its position furthest to the left from the point of view of FIG. 2. It may be appreciated that the crank connecting member moves with piston connecting member 50 in motion parallel to axis 30, but moves slidably with respect to the piston connecting member in movement perpendicular to axis 30. This is of course necessary because piston connecting member 50 cannot move in the direction perpendicular to axis 30. Thus it may be seen that bushing 60 serves to support the crank connecting member in such a way as to permit relative movement between the piston connecting member and the crank connecting member along longitudinal axis 96 of the crank connecting member, while carrying the piston connecting member and the crank connecting member together in movement parallel to cylinder axis 30.

In the illustrated embodiment, it may be seen that the longitudinal axis 96 of the crank connecting member and the cylinder axis 30 extend along a common plane, which is the plane of the drawing in FIGS. 1 and 2. Likewise in this embodiment, the axes of rotation of the crankshafts are perpendicular to this plane.

Figure 3:
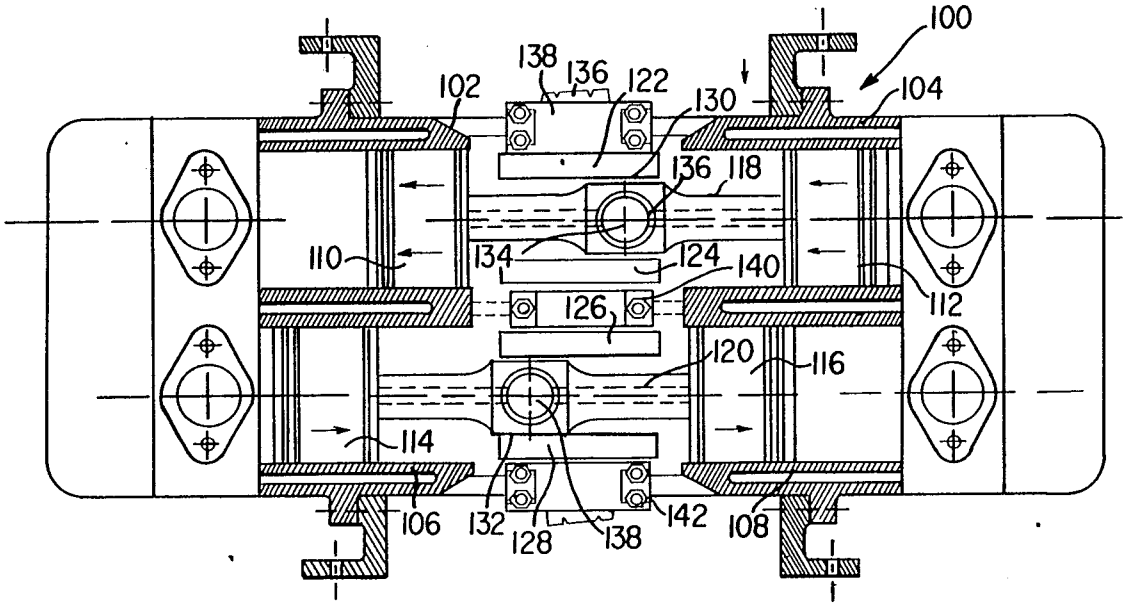
FIG. 3 is a plan view of a four cylinder piston apparatus according to the invention, showing the cylinders in section.

FIG. 3 illustrates an apparatus 100 which is similar in principle to apparatus 1 of FIGS. 1 and 2, but has four cylinders 102, 104, 106 and 108. Pistons 110, 112, 114, and 116 are slidably received in the cylinders. The cylinders are arranged in opposite pairs, one pair being cylinders 110 and 112, while the other pair is cylinders 106 and 108. The pairs of pistons are interconnected by piston connecting members 118 and 120. A pair of crank members 122 and 124 are located on each side of piston connecting member 118. Likewise, crank members 126 and 128 are connected on opposite sides of piston connecting member 120. A crankpin 130 extends between crank members 122 and 124, while a crankpin 132 extends between crank members 126 and 128. The crank members described are bottom crank members below piston connecting members 118 and 120, there being equivalent top crank members not shown in this view which function as does top crank member 70 for the embodiment of FIGS. 1 and 2. A crank connecting member 134 is slidably received in bearing 136 of piston connecting member 118. The lower end of crank connecting member 134 has a bearing similar to bearing 68 at the bottom end of crank connecting member 88 of FIGS. 1 and 2. This bearing rotatably receives crankpin 130. The upper end of crank connecting member 134 is provided with a bearing rotatably receiving the crankpin of the upper crank members. The other pair of cylinders and pistons has an equivalent crank connecting member 138. The bottom crank members are connected together by a common crankshaft 136 rotatably supported in bearings 138, 140 and 142. The upper crank members are similarly connected by a common crankshaft. The upper and lower crankshafts are mechanically coupled by gears equivalent to gears 82, 84 and 86 of the embodiment of FIGS. 1 and 2.

From this description it may be seen that the embodiment of FIG. 3 is similar to the embodiment of FIGS. 1 and 2, but has two pairs of pistons and cylinders, two piston connecting members and two crank connecting members. It may also be observed in FIG. 3 that the crank members associated with the two pairs of pistons and cylinders are displaced 180° apart. This may be observed with reference to crankpin 130 which is 180° apart in angular spacing from crankpin 132. The effect of this is seen in FIG. 3 where pistons 110 and 112 are at their furthest position to the right from the point of view of the Figure, while pistons 114 and 116 are at their position furthest to the left. The relative positions of the two pairs of pistons is therefore to achieve minimum vibration.

It is readily comprehensible to a man skilled in the art that the apparatuses as described above are suitably modified to act as internal combustion engines, external combustion engines or pumps or compressors. For example, the apparatuses can function as internal combustion engines by adding valves to the cylinder heads 32 and 34 illustrated in FIGS. 1 and 2. The valves would be located under valve covers 144 and 146. Camshafts for the valves would also be provided together with the other components necessary for an internal combustion engine such as intake means for fuel and air, exhaust means and ignition means. It is well within the abilities of a man skilled in the art to provide such means after having the advantage of the above disclosure.

Clearly many modifications and additions can be made without departing from the scope of the invention. For example, a six cylinder version of the piston apparatus can be provided by adding a third pair of cylinders to the four shown in FIG. 3. In this case the crank members would have a relative displacement of 120° from each other.

What is claimed is:

1. A piston apparatus comprising:

(a) a first pair of spaced-apart cylinders aligned along a cylinder axis;

(b) a pair of pistons, each piston being slidably received in one of the cylinders for reciprocation along the axis;

(c) a pair of spaced-apart crank members on opposite sides of the cylinder axis, the crank members having parallel axes of rotation;

(d) a first gear wheel, a second gear wheel and a third gear wheel, the first and second gear wheels being operatively connected to the crank members, the third gear wheel meshing with and being located between the first and second gear wheels, the third gear wheel being rotatable about an axis midway between the axes of rotation of the crank members and parallel thereto, the gear wheels being adapted to couple the crank members together for rotation at the same rotational speed and in the same direction;

(e) a crank connecting member having a longitudinal axis which is perpendicular to the cylinder axis and having opposite ends, each said end only being rotatably connected to one of the crank members a distance from the axis of rotation thereof, the crank connecting member being connected at a distance equal at each end from the axis of rotation of the crank member connected thereto, the longitudinal axis of the crank connecting member and the cylinder axis extending along a common plane, the axes of rotation of the crank members being perpendicular to the plane; and (f) a piston connecting member interconnecting the pair of pistons and having an aperture extending therethrough in a direction perpendicular to the cylinder axis, the crank connecting member being slidably received in the aperture to permit relative movement between the piston connecting member and the crank connecting member along the longitudinal axis of the crank connecting member, the piston connecting member and the crank connecting member being carried together for movement parallel to the cylinder axis.

2. A piston apparatus as claimed in claim 1, wherein the aperture and the crank connecting member are circular in section and the piston connecting member is an elongated rod having the aperture in a central portion thereof.

3. A piston apparatus as claimed in claim 1, further comprising a second pair of spaced-apart cylinders provided with associated pistons, crank members, crank connecting members and piston connecting members corresponding to said pistions, crank members, crank connecting members and piston connecting members of the first pair of cylinders, the crank members associated with the second pair of cylinders being operatively connected to the crank members of the first pair of cylinders for rotation therewith at a relative displacement of 180 degrees.

4. A piston apparatus as claimed in claim 3, wherein the second pair of cylinders are aligned along a second cylinder axis which is parallel to the cylinder axis of the first pair of cylinders.

5. A piston apparatus as claimed in claim 3, wherein the crank members are connected to first and second crankshafts extending along the axes of rotation of the crank members.

6. A piston apparatus as claimed in claim 5, wherein the first and second gear wheels are connected to the first and second crankshafts respectively, and the third gear wheel meshes with the first and second gear wheels, the third gear wheel being rotatable about an axis midway between the axes of rotation of the crank members and parallel thereto.

* * * * *